United States Patent [19]

Hughes et al.

[11] Patent Number: 4,693,386

[45] Date of Patent: Sep. 15, 1987

[54] COLLAPSIBLE SHIPPING CONTAINER

[75] Inventors: Larry R. Hughes, Lindsay; Michael L. Dorsey, Sunderland; David Wensley, Lindsay, all of Canada

[73] Assignee: Bonar Rosedale Plastics Ltd., Markham, Canada

[21] Appl. No.: 820,777

[22] Filed: Jan. 21, 1986

[30] Foreign Application Priority Data

Jan. 22, 1985 [CA] Canada ..... 472570

[51] Int. Cl.[4] ..... B65D 7/24

[52] U.S. Cl. ..... 220/1.5; 220/6; 220/7

[58] Field of Search ..... 220/1.5, 6, 7; 206/509

[56] References Cited

U.S. PATENT DOCUMENTS

| | | | |
|---|---|---|---|
| 3,907,150 | 9/1975 | Jurasek | 220/19 |
| 3,981,410 | 9/1976 | Schurch | 220/6 |
| 4,044,910 | 8/1977 | Box | 220/7 |
| 4,081,099 | 3/1978 | Shead | 220/6 |
| 4,173,289 | 11/1979 | Nesti | 220/7 |
| 4,186,841 | 2/1980 | Buckley et al. | 220/6 |
| 4,320,845 | 3/1982 | Waller | 220/6 |
| 4,591,065 | 5/1986 | Foy | 220/7 |

*Primary Examiner*—Steven M. Pollard

*Attorney, Agent, or Firm*—Neuman, Williams, Anderson, Olson

[57] ABSTRACT

A collapsible shipping container has a rectangular base and four side walls pivotally attached to the base and foldable from an erect condition to a collapsed condition. Captive fastener means on the walls are operated to interconnect them in the erected condition. The entire shipping container is made of plastics material without the inclusion of any metal parts.

17 Claims, 26 Drawing Figures

COLLAPSIBLE SHIPPING CONTAINER

FIELD OF THE INVENTION

This invention relates to a new or improved collapsible shipping container which can be folded or retracted into a compact collapsed condition when not in use to save space during storage and transport.

Numerous prior designs of this general class of shipping container have been proposed, one such being described in our prior Canadian Patent No. 1,159,379 dated Dec. 27, 1983 Howard B. Carter, et al. The shipping container described hereinafter is an improvement upon that of Canadian Patent No. 1,159,379 and incorporates numerous advantageous features.

SUMMARY OF THE INVENTION

The present invention provides a collapsible shipping container comprising: a rectangular base, and four side walls each pivotally attached at a respective side of the base on a horizontal axis parallel to that side, each wall being pivotable between an upright position, wherein it extends normal to the base, and a retracted position wherein it overlies the base, the container being adjustable from an erected condition, wherein all four walls are in the upright position, to a collapsed condition wherein all four walls are in the retracted position, the adjacent edges of neighbouring walls being configured to provide mutual support when in the upright position, said walls carrying captive releasable fastener means that engage between neighbouring walls to lock them in the upright position, said fastener means comprising a latch pin movably attached to one wall and selectively insertable in a socket in an adjacent wall to secure said walls together in the upright position.

Since the fastener means is attached to an associated wall it cannot become misplaced or lost. Preferably the fastener means comprises an elongate mounting pin and a spaced parallel short latching pin interconnected by a transverse strap. The mounting pin is pivotably and axially movably mounted in one wall and can be manipulated to insert the latch pin in a socket in the adjacent wall when the container is erected, or in an auxiliary or storage socket in its own wall when the fastener is not in use. Preferably both sockets receive the latch pin with a friction or interference fit to prevent inadvertent displacement.

All component parts of the shipping container may be fabricated in suitable plastics material. The side walls and base may be formed by roto-moulding in polyethylene, and the fasteners and hinges for the side walls may be moulded in nylon.

Preferably the base is formed with a continuous dependent peripheral wall formed with pockets to receive the tines of the fork-lift truck to facilitate handling of the container. Such pockets improve the safety in handling the collapsible container as compared with arrangements wherein the fork-lift tines engage in open-bottomed recesses, since the closed lower sides of the pockets prevent the container from tipping laterally relative to the tines. Similar containers may be stacked one on top of the other whether in erected or collapsed condition, and suitable interengaging ribs and recessed grooves are preferably provided to retain stacked containers in register with one another.

BRIEF DESCRIPTION OF THE DRAWINGS

The invention will further be described, by way of example only, with reference to the accompanying drawings wherein.

DESCRIPTION OF THE PREFERRED EMBODIMENT

Figure 1:
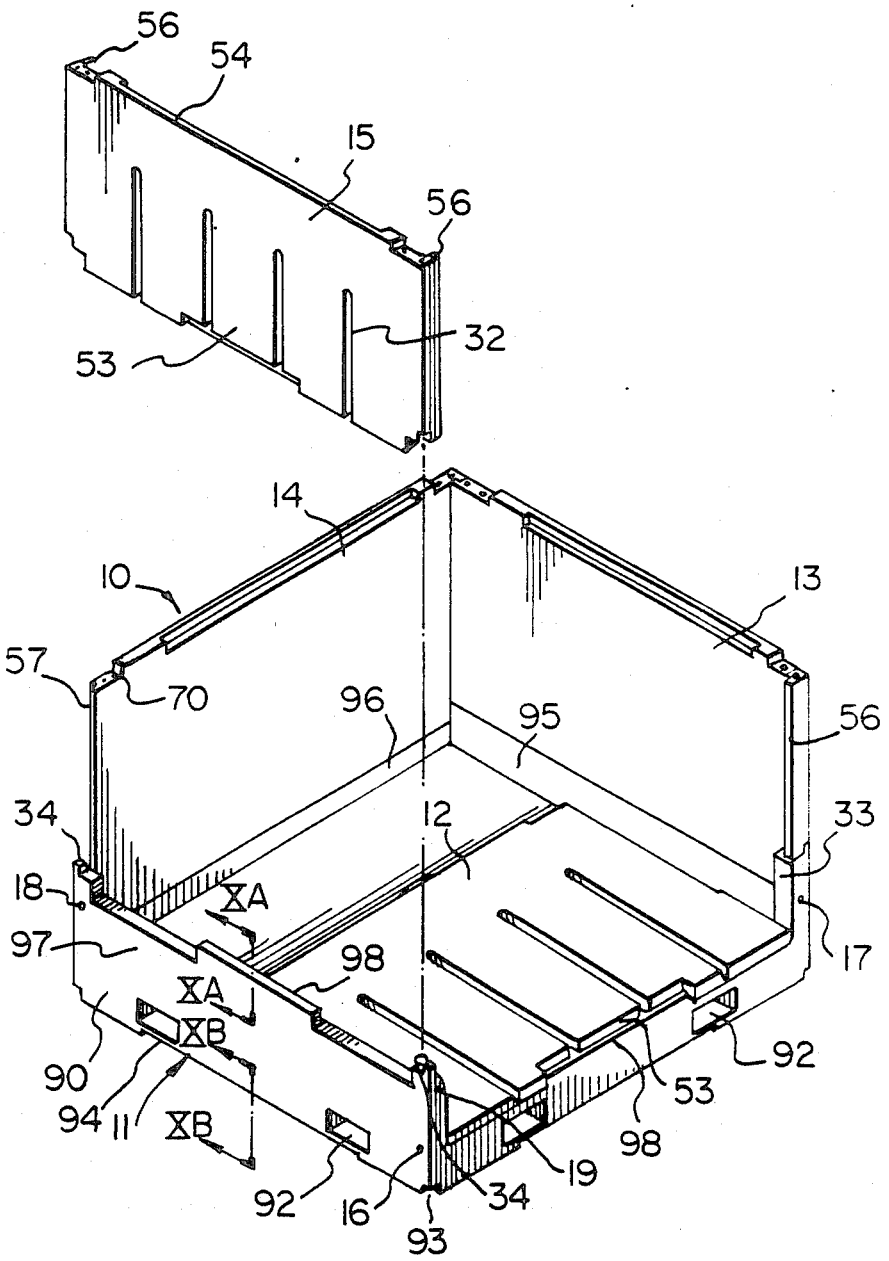
FIG. 1 is an isometric view of a presently preferred embodiment of the invention showing a shipping container in a partially erected condition, one wall of the container being shown detached.

With reference to FIG. 1, the shipping container 10 comprises a rectangular base 11 and four side walls 12, 13, 14 and 15. Each wall is pivotally connected at a corresponding edge of the base on a pivotal axis 16, 17, 18 and 19 respectively. Each wall can be pivoted about its axis between an upright position wherein it extends normal to the base 11 and a retracted position wherein it is folded down through 90° and overlies the base. In FIG. 1 the wall 12 is shown in the retracted position whereas walls 13 and 14 are shown in the upright position.

The pivotal axis 16, 17, 18 and 19 are at progressively increasing heights above the space 11 so that the walls 12, 14, 13 and 15 when folded in succession can lie on top of one another and parallel to the base 11. The walls 12, 13, 14 and 15 are accordingly of varying heights so that in the erected condition the upper ends of the walls lie in a common horizontal plane.

Figure 11:
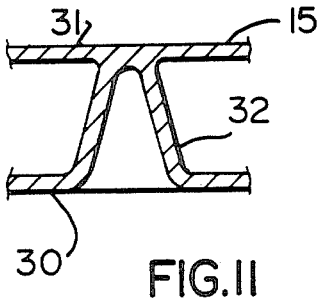
FIGS. 11 and 12 are sectional views to an enlarged scale taken on the lines XI—XI and XII—XII in FIG. 1.

The walls may be fabricated of any suitable material. In the example illustrated the walls are of thermoplastic material, specifically, polyethylene, and are formed by roto-moulding. As indicated in FIG. 11, the wall 15 (and likewise the walls 12, 13 and 14) is moulded to constitute outer and inner spaced thermoplastic panels 30 and 31 which are interconnected around their edges to form a hollow structure, intermediate areas of the walls being braced by elongate V-shaped formations 32 through which the outer and inner panels 30,31 are interconnected. The resulted structure is lightweight yet of relatively high strength. In certain applications where additional strength is required, the hollow interior of the walls 12 to 15 may be filled by a lightweight plastics foam.

Figure 5:
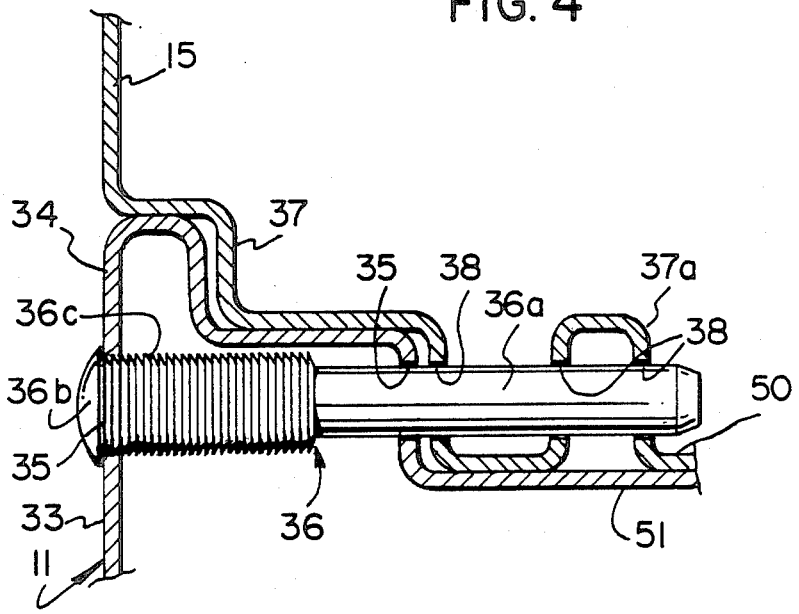
FIG. 5 is a sectional view to an enlarged scale taken on the line V—V in FIG. 4.
Figure 18:
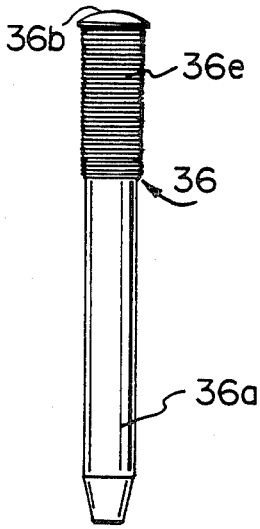
FIG. 18 is an elevational view of a hinge pin.

The arrangement by which each of the walls 12, 13, 14 and 15 is pivotally connected to the base can be seen with reference to FIGS. 5, 7, 8, 13 and 14. The base is formed with four upwardly projecting corner posts 33 each of which includes an upwardly projecting square stud 34 and has an integrally formed registering circular openings 35 in opposed pairs of vertical faces, which openings define the location of the pivot axes 16, 17, 18 and 19 of the container walls. FIG. 5 is an enlarged sectional view of one lower corner of the container wall 15 illustrating how the openings 35 in the corner post 33 locates the pivot axis 19. A pivot pin 36 is shown in FIG. 18 and comprises a cylindrical shank 36*a* having a tapered end and a convex head 36*b* at its opposite end, a section of the shank adjacent the head being formed with a series of ring-formed serrations 36*c* which are of a larger diameter than the shank 36*a* and which form a series of annular ridges directed generally towards the head 36*b*. The lower corner of the wall 15 has a recessed portion 37 adapted to accommodate the shape of the corner post 33, stud 34 and pivot pin 36, the shank 36*a* of the pivot pin 36 extending through a series of aligned opening 38 in the recessed portion 37 to form an attachment between the wall 15 and the pivot pin 36. One of the openings 38 is formed in the recess 37, and two additional openings 38 are formed in a secondary indented recess 37*a* formed near the lower corner of the wall. These three openings 38 form a bearing connection with the cylindrical shank 36*a* of the pivot pin 36. It will be appreciated that with the wall held in position and the base openings 35 aligned with the wall openings 38, the pivot pin 36 can be inserted successively through these aligned apertures. The ring serrations 36*c* form and interference fit with the outermost opening 35 and must be driven through this opening with some force. Thus when the pivot pin is in the fully inserted position as shown in FIG. 5 the serrations 36*c* secure it against removal. The opposite end of the wall 15 is formed with a recessed portion 39 that is somewhat similar to the recessed portion 37, and has horizontal openings 38 to receive the shank 36*a* of a pivot pin 36 (not shown in FIGS. 13 and 14). As noted, the openings 36 bear upon the cylindrical shank surface of the pivot pin 36 and form a bearing support therewith during pivotal movement of the associated wall 15 between the upright position and the retracted position. To accommodate such pivotal movement without requiring excessive clearance between the lower edge surface 50 of the wall 15 and the confronting surface 51 of the base, the wall 15 is cylindrically curved in its inwardly facing portion 52 (see FIGS. 12 and 13), this curvature being centered around the pivot axis 19.

Figure 12:
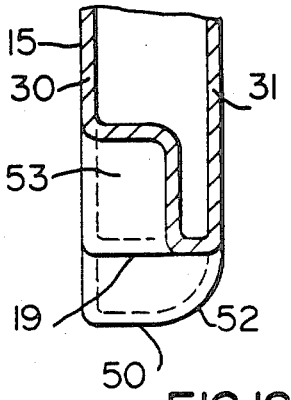
Figure 14:
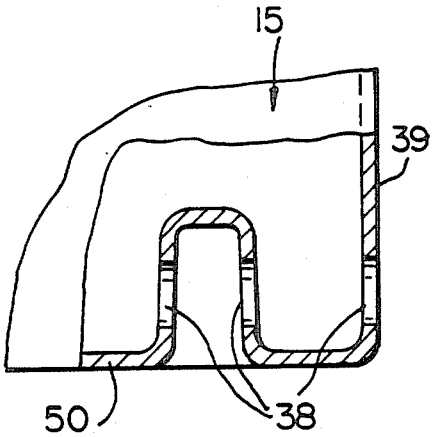
FIG. 14 is a sectional view taken on the line XIV—XIV in FIG. 13.
Figure 13:
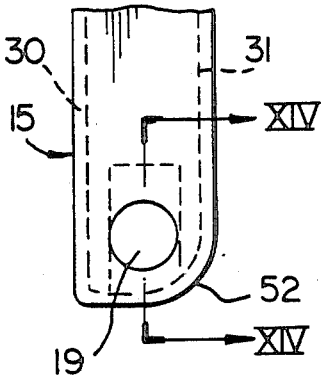
FIG. 13 is an enlarged fragmentary view taken in the direction of the arrow XIII in FIG. 1.

As shown in FIG. 1, and in greater detail in FIG. 12, the lower edge of each of the walls 12 to 15 is formed centrally thereof with a large rectangular recess 53 adjacent the outer panel 30. The upper edge 54 of each wall is formed with an elongate rectangular rib 55 adjacent the outer panel 30. The purpose of the recesses 53 and ribs 55 will be explained below.

Figure 2:
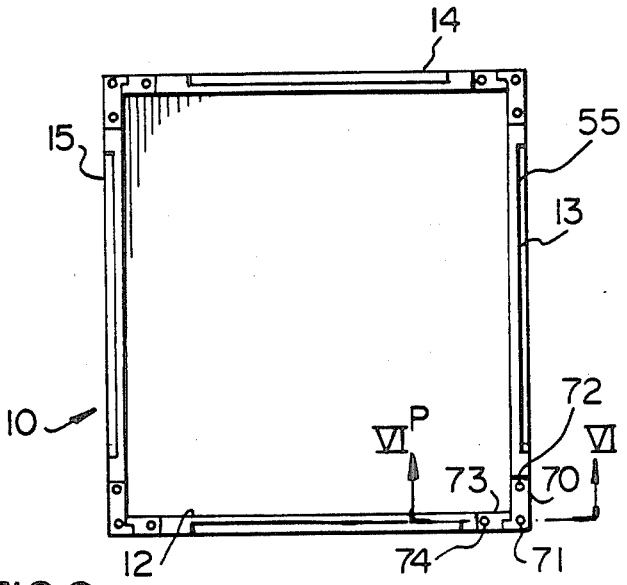
FIG. 2 is a plan view of the shipping container in erected condition.

As can be seen in FIGS. 1 and 2, each of the walls 12, 13, 14 and 15 is configured along its vertical edges so that in the erected position adjacent walls provide mutual support. Specifically, as seen in FIG. 1, the wall 15 is formed on both of its vertical edges with a rectangular rib 56 which, in the upright position, engages in a complimentary rectangular recess 57 in the adjacent edge of the neighbouring walls 14 and 12 when the latter are moved to the upright position. Similar rib and recess formations are provided at the adjacent edges of walls 14 and 13, walls 13 and 12, and walls 12 and 15. The walls 12 and 14 do not have a projecting rib 56, but rather are formed with two recesses 57. This facilitates manipulation of the walls between the upright and retracted position by one person unassisted.

Figure 15:
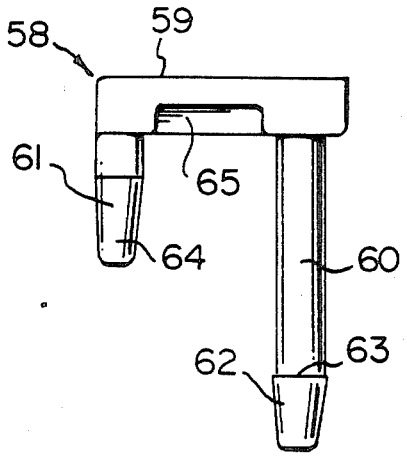
FIG. 15 is an elevational view of a fastening means.

To securely inter-engage the walls with respect to one another when in the upright position, and thus lock the container in the erected condition, a number of captive releasable fastener means are provided for inter-engaging the walls at their adjacent edges. In the form illustrated, the fastener means comprises a locking pin 58 as best shown in FIG. 15. The pin 58 comprises a generally rectangular strap 59 from one end of which projects an elongate cylindrical mounting pin 60 and from the opposite end of which projects a somewhat shorter latch pin 61. The mounting pin and latch pin are of the same diameter, the distal end of the mounting pin having a tapered nose section which terminates in a shoulder 63 of somewhat increased diameter. The latch pin 61 terminates in a slightly tapered nose. On opposite sides of the lower surface of the strap 59 are a pair of rectangular recesses 65.

Figure 6:
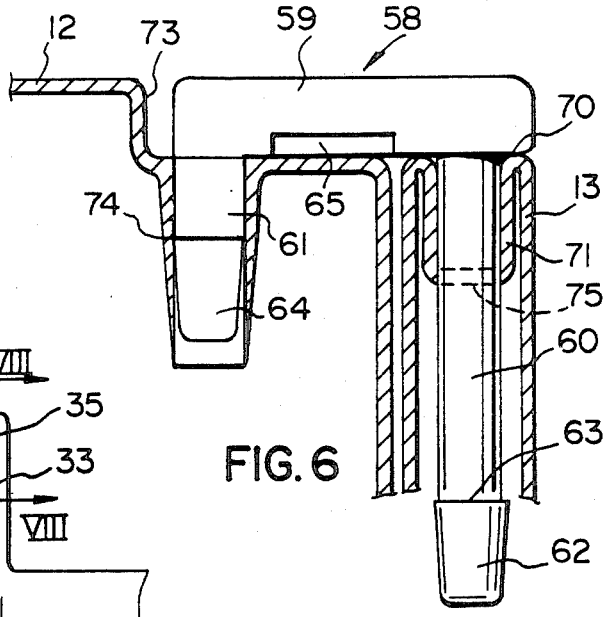
FIG. 6 is a sectional view to an enlarged scale taken on the line VI—VI in FIG. 2.

As shown in FIGS. 1, 2 and 6, the upper ends of the walls 12 to 15 are formed with a series of moulded tubular sleeves which form mounting end attachment means for the locking pins 58. More specifically and referring to the lower right hand corner of FIG. 2, it will be seen that in a recess 70 formed in the upper edge of the wall 13 there is provided an integrally moulded mounting sleeve 71 and an integrally moulded storage sleeve 72. In a similar recess 73 in the upper edge of the adjoining wall 12 there is an integrally moulded locking sleeve 74. The sectional view of FIG. 6 illustrates how the locking pin 58 is used to form a locking attachment between the walls 12 and 13. The locking pin is installed by inserting its mounting pin 60 through the sleeve 71. The internal diameter of the sleeve 71 corresponds to the diameter of the cylindrical portion of the locking pin 60 and is somewhat smaller than the shoulder 63. However the nose 62 and shoulder 63 can be forced downwardly through the sleeve 71 due to the inherent resilience of the thermoplastic parts from which the components are fabricated. It will be seen that when the strap 59 abuts the recess 70, the shoulder 63 is positioned a substantial distance below the lower edge 75 of the sleeve 71. The locking pin can therefore be raised upwards until the shoulder 63 abuts the lower edge 75 such abutment preventing total withdrawal of the locking pin 58 which accordingly is held in captive relationship with its associated wall.

To form an attachment between the walls 12 and 13, the locking pin 58 is raised until the nose 64 of the latch pin 65 is above the recesses 70 and 74 whereupon the locking pin can be rotated to bring the latch pin 61 into alignment with the locking sleeve 74. The locking pin 58 can thereupon be pressed downwards to insert the latch pin 61 into the locking sleeve 74 and thereby form a locking connection between the walls 12 and 13. The diameter of the latch pin 61 is preferably slightly greater than the internal diameter of the locking sleeve 74 so that there is a slight interference between these two components when engaged. This interference can be accommodated by the resilience of the material from which the parts are fabricated and will serve to prevent accidental disengagement. The manipulation, engagement and disengagement of the locking pin 58 are facilitated by the recesses 65 which act as aids to manual manipulation of the locking pin. The storage sleeve 72 in the recess 70 of wall 13 is of a similar configuration to the locking sleeve 74 and receives the latch pin 61 when the container walls are not interconnected, e.g. when the container is in the collapsed condition for storage or transport.

As mentioned above, the walls of the container can be manipulated from the erected condition to the collapsed condition by a single person unassisted, and this is due to the configuration of the ribs 56 and recesses 57 formed in the edges of the walls, and the arrangement of the locking pins 58. With reference to FIG. 1 it will be appreciated that when the container is in the erected condition, disengagement of the locking pins 58 acting between the wall 12 and the adjacent walls 15 and 13 will enable the wall 12 to be released and folded onto the base in the position shown in FIG. 1. Thereafter, the walls 14, 13 and 15 can be folded down in succession upon disengagement of the associated locking pins 58. To reverse this sequence, first the wall 15 is raised and then the wall 13. The walls are self supporting in this condition and the operator may then move around the container to raise and secure the remaining walls 14 and 12.

It will be readily seen from FIGS. 1 and 2, that when the container is in the erected condition, the walls 12 and 14 are supported against outwardly imposed loads which may be produced by the contents of the container by interengagement of their marginal recesses 57 with the ribs 56 on the edges of the walls 13 and 15. These ribs and recesses do not however support the walls 13 and 15 against such forces, but rather these forces are resisted by the latch pins 58, which when engaged have their strap portions 59 extending at right angles to the walls 13 and 15 and so prevent outwards movement of these walls.

Figure 3:
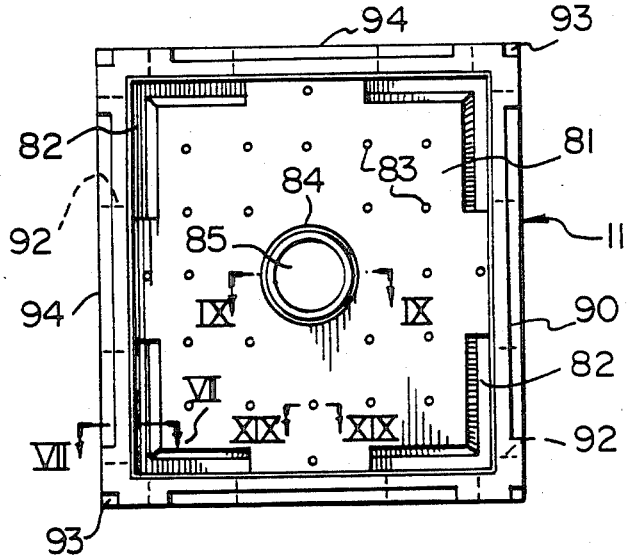
FIG. 3 is an underneath plan view.
Figure 7:
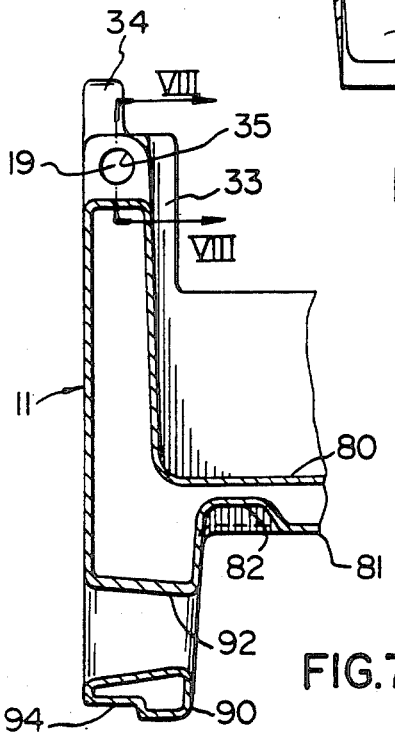
FIG. 7 is a sectional view to an enlarged scale taken on the line VII—VII in FIG. 3.
Figure 8:
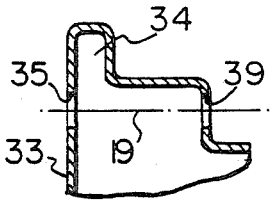
FIG. 8 is a sectional view taken on the line VIII—VIII in FIG. 7.
Figure 9:
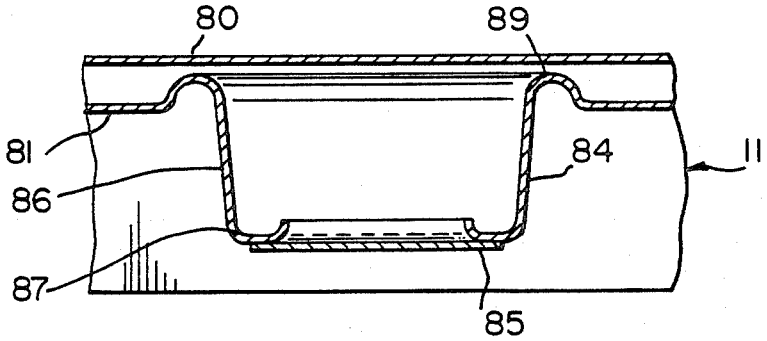
FIG. 9 is a sectional view to an enlarged scale taken on the line IX—IX in FIG. 3.
Figure 19:
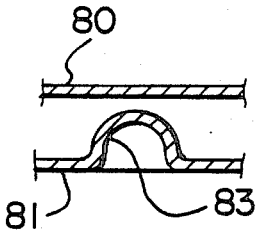
FIG. 19 is a sectional view taken on the line XIX—XIX in FIG. 3.

The structure of the base 11 can best be seen in FIGS. 1 and 3 and in the sectional views shown in FIGS. 7, 8, 9, 10A and 10B. As in the case of the walls 12 to 15, the base is fabricated in a suitable thermoplastics material such as polyethylene, by roto-moulding and is of double walled construction. The hollow interior of the base may be filled with a suitable light-weight foam material such as to improve the strength and rigidity of the base without making it excessively heavy. The base comprises an upper horizontal rectangular panel 80 of plain configuration which is spaced above a lower panel 81 in which various formations are moulded to improve the strength and structural integrity of the base. Thus as seen in FIGS. 3 and 7, at each corner of the lower panel 81 there is a large L-shaped recess. Furthermore, throughout the area of the lower panel 81 is a series of regularly spaced hemispherical indentations 83 (see FIG. 19). Centrally of the lower panel is a large centre post structure 84, the form of which is most clearly seen in FIG. 9. The structure 84 comprises a slightly tapered cylindrical wall 86 the lower end of which merges into a rim 87 that surrounds a circular opening that is closed by a welded patch 85. The upper end of the outer wall 86 merges with the lower panel 81 through a rounded annular rib 89.

Figure 10A:
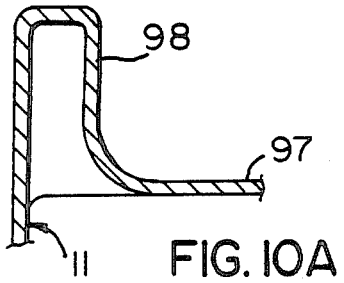
FIGS. 10A and 10B are sectional views to an enlarged scale taken on the lines XA—XA and XB—XB in FIG. 1.
Figure 10B:
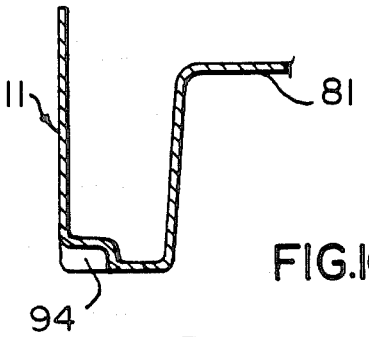

On the underside of the base 11 is a continuous dependent peripheral wall arrangement 90. The wall 90 is re-inforced in suitable fashion and incorporates a series of horizontal pockets 92 designed to receive the tines of a fork-lift truck or similar lifting device to facilitate transportation of the container. The bottom of the center post 84 is spaced a sufficient distance above the lower edge of the wall 90 that in use, even under heavily loaded conditions it will not deflect below this lower edge and thus cannot damage goods in a lower container when in stacked condition. To facilitate stacking of containers one upon the other when in the collapsed condition, at each lower corner of the wall 90 there is a rectangular recess 93 which is sized and located to receive a square stud 34. Furthermore, as seen in FIG. 1 and FIG. 10B, an elongate outwardly open recess 94 is provided centrally in each side section of the wall 90, this recess 94 being designed to receive a rib 55 when the container is stacked upon a similar erected container.

At its sides corresponding to the position of the walls 13, 14 and 15, the base has upwardly extending flanges 95, 96 and 97 of different heights such that the combined height of the wall and flange (13, 95:14, 96:15, 97) corresponds to the height of the wall 12 such that in the erected condition of the container the tops of all of the walls lie in a common horizontal plane. An upwardly projecting rectangular lug 98 is positioned centrally on top of the flanges 95, 96 and 97 and centrally of the remaining side of the base 11. As seen in FIG. 10B the lug is of narrow width and is positioned adjacent the outer edge of the base. The lug 98 is in registering position with respect to the recess 53 in the corresponding container wall and is received therein when the wall is in the upright position. As will be evident from the configuration of the lug 98 and the complimentary recess 53, the lug will serve to support the central portion of the lower edge of the wall against outward deflection which might be induced by objects carried within the container.

Figure 20:
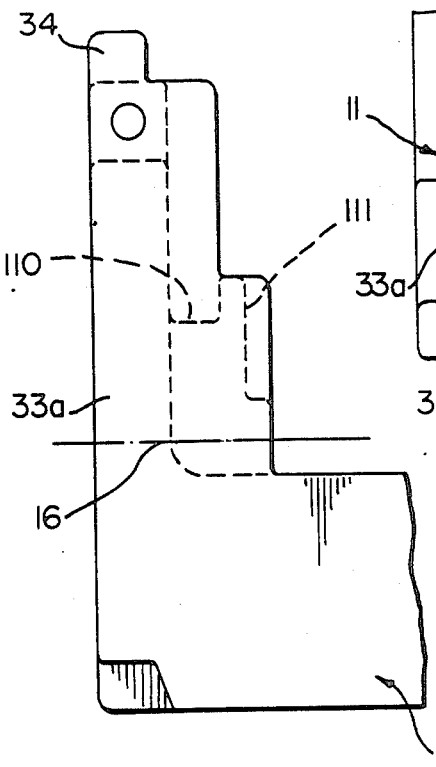
FIG. 20 is an enlarged fragmentary elevational view of the front left portion of a modified form of container base.
Figure 21:
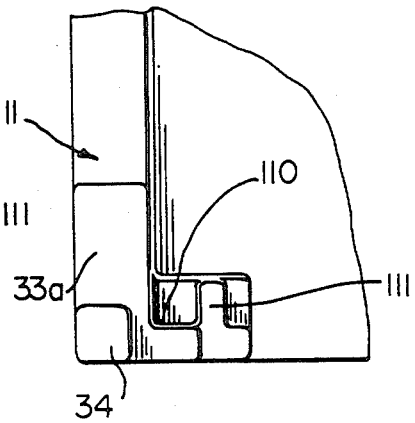
FIG. 21 is a plan view corresponding to FIG. 19.
Figure 22:
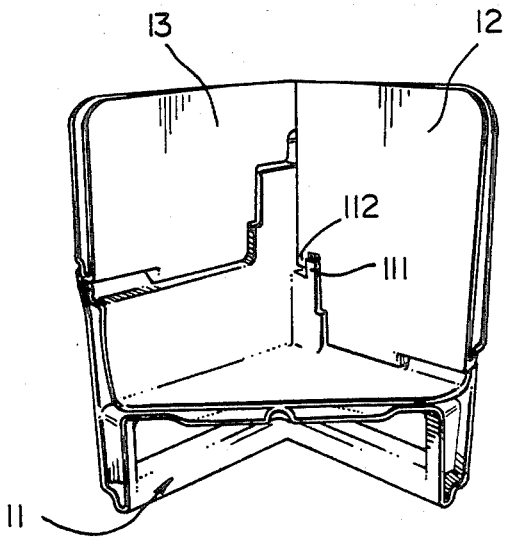
FIG. 22 is a fragmentary perspective view from the interior of an erected container including the modification of FIGS. 19 and 20.

As will be appreciated from a consideration of FIGS. 1 and 2, the interaction of the ribs 56 in the walls 13 and 15 with the recesses 57 in the walls 12 and 14 ensure that outwardly directed forces imposed upon the walls 12 and 14 by the contents of a container are applied as tensile loads on the walls 13 and 15, and are absorbed thereby. However in contrast to this, outwardly directed forces applied to the walls 13 and 15 are not transmitted directly to the walls 12 and 14, and thus must be absorbed at the lower end by the corner posts 33 of the base. Depending upon the loads encountered, this might tend to cause an excessive deflection of these corner posts, and to counteract this condition, the improved construction illustrated in FIGS. 20 to 22 has been devised. As shown in FIG. 20, the base 11 has corner posts 33*a* of increased thickness and modified by the provision of a rectangular recess 110 opening inwardly of the corner post. Adjacent this recess is a rectangular lug 111, both of these being positioned above the pivot axis 16 for the wall 12. The corresponding lower corner of the wall 12 (FIG. 22) is formed with a projecting lug 112 which in the erected condition of the wall as shown in FIG. 22 is received in the recess 110. The opposite end of the wall 12 and its corner post 33*a* are configured in like manner. It will be evident therefore that interaction of the lugs 111 on the corner posts 33*a* with the lugs 112 on the wall 12 will support the corner posts against deflection caused by outwardly imposed loads on the walls 13 and 15, and will apply such loads as tensile forces in the wall 12. The wall 14 and its adjacent corner posts are configured in like manner.

When the container is in the collapsed condition its height is approximately one third of its height when in the erected condition. When collapsed, the square studs 34 on the corner posts 33 are at the same height and cooperate with the corner recesses 93 when the containers are stacked on top of one another.

Figure 4:
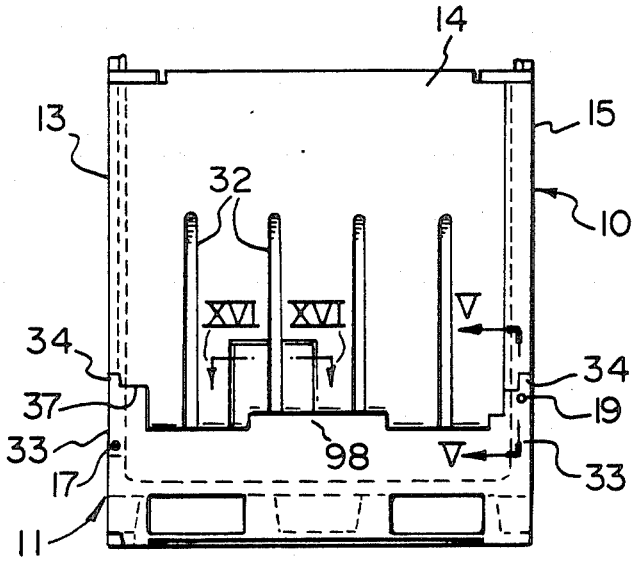
FIG. 4 is a front view.
Figure 16:
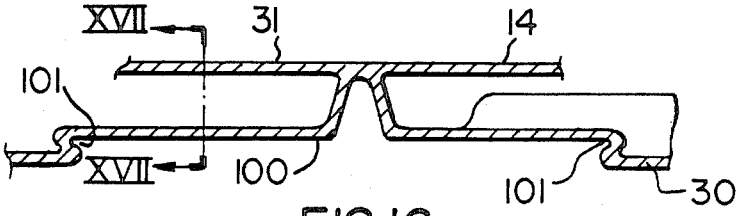
FIG. 16 is a sectional view taken on the line XVI—XVI in FIG. 4.
Figure 17:
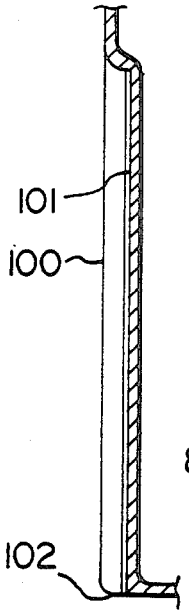
FIG. 17 is a sectional view taken on the line XVII—XVII in FIG. 16.

As shown in FIGS. 4, 16 and 17, one or more walls of the container may be provided with a preformed moulded card holder recess 100, at any suitable location thereof. As shown in FIG. 4 the recess is of generally rectangular form and is located adjacent the lower edge of the wall. FIG. 16 shows the recess 100 with undercut grooved vertical edges 101 which will assist in retaining a card or identifying tag in the recess 100. The bottom 102 of the recess is open as shown by FIGS. 16 and 17 and may serve as an entrance for insertion of a card or the like when the wall is folded down. However then the wall is erect, this lower end is closed by the adjacent wall of the base.

In shipping containers of the general class described, it is known to utilize a half fold-down side wall to facilitate access to the contents of the container when in erected condition. FIG. 24 shows a shipping container wherein the wall 13 is replaced by a wall 120 having a half fold-down side. The structure of the wall 120 is more clearly shown in FIG. 23 as comprising a main wall section 121 which is mounted in the base 11 in the same manner as the wall 13 to be pivotable from a collapsed condition to an erect condition where it interlocks with the adjacent walls 12 and 14. Opening from the upper side of the wall 120 is a large cut-out recess 122 in which is received a fold-down wall section 123 of similar outline. As illustrated in FIG. 24, the fold-down wall section 123 is pivoted at its lower edge to the main wall section 121 by means of hinges 124 and can be swung from the closed condition shown, outwardly and downwardly by means of the hinges to open the cut-out area 122 to provide access to the interior of the shipping container.

Figure 24:
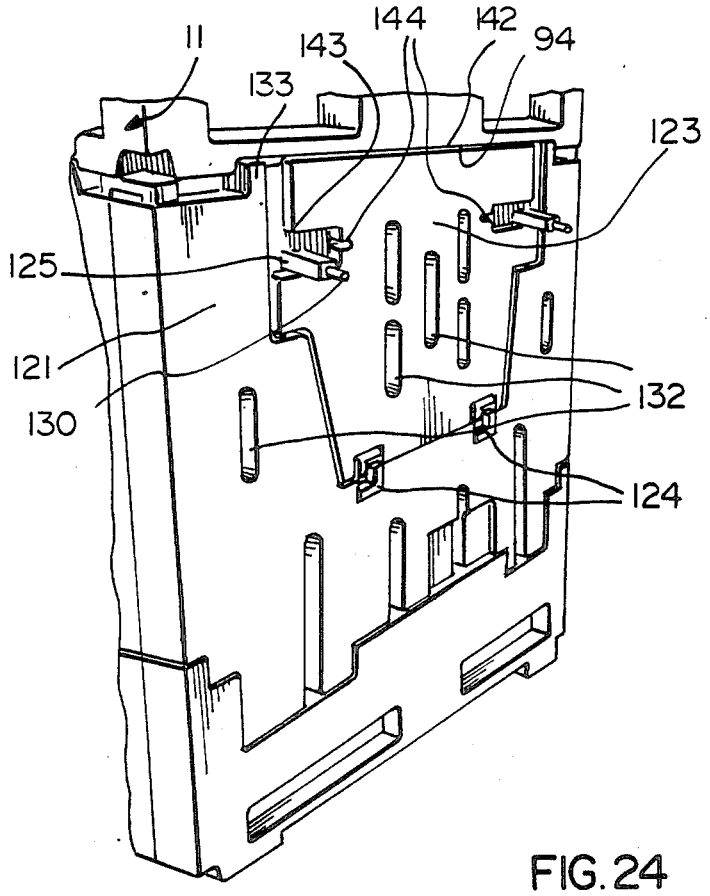
FIG. 24 is a fragmentary perspective view of a shipping container including the modified wall of FIG. 23.
Figure 25:
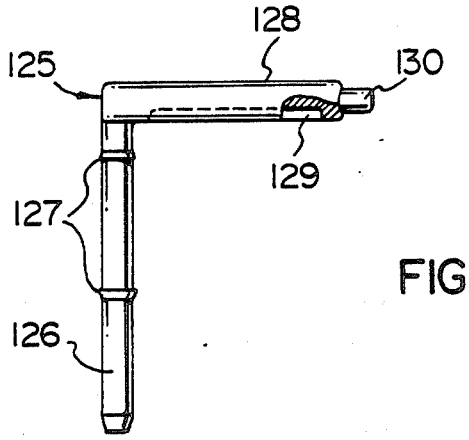
FIG. 25 is an elevational view of a locking pin which is incorporated in the wall of FIG. 23.

To secure the fold-down wall section 123 in the closed position as shown in FIG. 24, there are provided a pair of latch pins 125, one of which is shown in more detail in FIG. 25. The latch pin 125 comprises a cylindrical rod 126 of elongate form having a pair of spaced annular ribs 127 thereon, and a lever arm 128 extending at right angles from its upper end. The lever arm is of generally rectangular cross section and has an elongated recess 129 on its underside to facilitate manipulation thereof. The outer end of the lever arm has a short cylindrical stud 130 projecting therefrom. The latch pin 125 is preferably formed as an integral molding in a suitable plastic material which may be the same as that employed for the pins 36 and 58 and hinges 124.

The sections of the wall 120 are of similar construction to the container walls as previously described, i.e. of double walled roto-molded plastics, the outer and inner walls being connected as before by a suitable arrangement of elongate V-shaped formations 132. At the upper edge of the main wall section 121 adjacent each side of the cut-out 122 is an upwardly projecting lug 133. The sides of the cut-out extend vertically downwards from the lugs 133, and then pass through a horizontal land surface 134 to a downwardly angled section 135 formed with an elongate rib 136. Opening from each land 134 is a vertically extending bore 137. The lower edge of the cut-out 122 has recesses 138 to receive the hinges 124, and also a recessed groove 139.

The configuration of the fold-down wall section 123 corresponds to that of the cut-out 122. The fold-down wall section has on its lower edge a projecting rib 140 to engage in the recess 139, and projecting elongate lugs 141 to cooperate with the ribs 136. At its upper end the fold-down wall section 123 has an elongate rib 142 which in the erected condition is aligned with the lugs 133 at its opposite ends. At each of its upper front corners, the fold-down wall section 123 has an L-shaped recess 143 having a vertical limb that is open laterally and upwardly, and a horizontal limb that terminates in a narrow slot 144. Below the recess 143, the fold-down wall section 123 is formed with a cylindrical through bore 145 aligned with the bore 137 in the main wall section 121 and adapted to receive in captive fashion the cylindrical rod 126 of a latch pin 125.

While being held captive in the bore 145, the rod 126 of the latch pin is movable axially therein, so that when the fold-down wall section 123 is in the vertical closed condition as shown in FIG. 24, the latch pin rod 126 can be selectively inserted in or withdrawn from the bore 137 by manipulation of the lever arm 128. As can be seen in FIG. 24, when the lever arm 128 of the latch pin extends outwardly from the wall 120, then the latch pin can be raised to move it axially upwardly out of engagement with the bore 137, the vertical limb of the L-shaped recess 143 accommodating this movement. However if the latch pin 125 is swung through 90° from the position shown in FIG. 24 to place the lever arm 128 within the horizontal limb of the recess 143, then upwards displacement, and hence disengagement, of the latch pin is prevented, and the fold-down wall section 123 is locked in the closed position. To prevent inadvertent movement of the latch pin 125 from this closed condition, the slot 144 is adapted to receive the latch pin stud 130 with a frictional interference fit.

The half fold-down wall arrangement described above in relation to FIGS. 23 to 25 offers a number of significant advantages. Thus the weakening of the wall 120 occasioned by the presence of the cut-out 122 therein is to some extent compensated for by the arrangement of the latch pins 125. Since the cylindrical rods 126 of these latch pins are in a vertical orientation, then the interengagement of the latch pins in the bores 137 and 145 is effective to transmit lateral forces from opposite sides of the cut-out 122 through the fold-down wall section 123, and thus stiffen the wall 120 against such forces.

Figure 23:
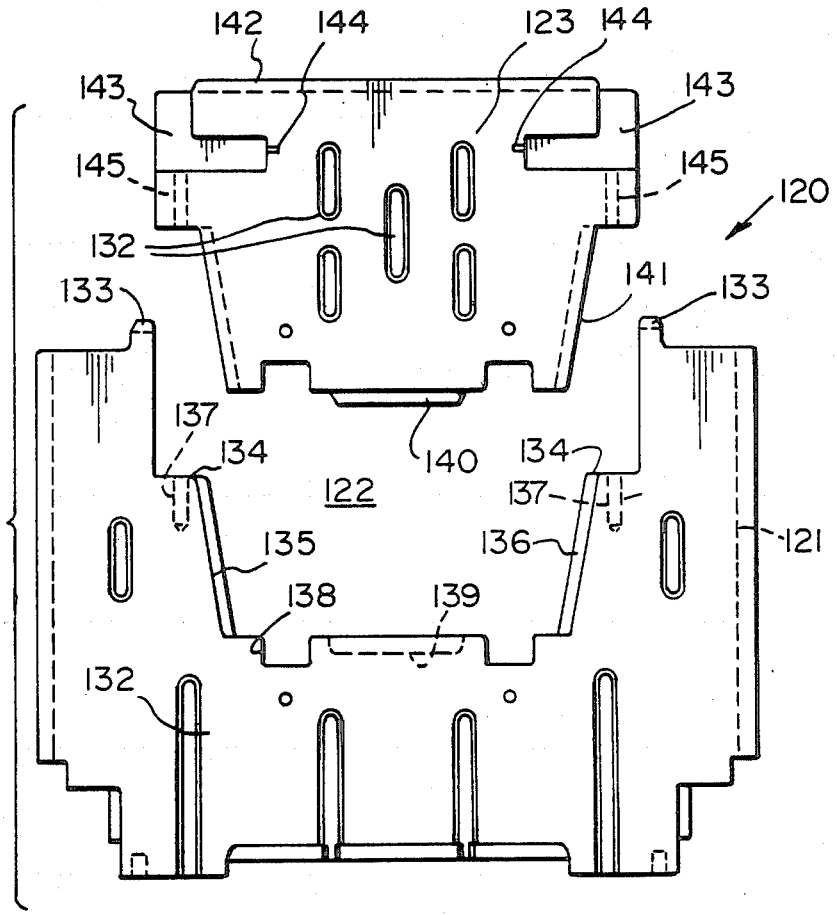
FIG. 23 is an exploded elevational view of a modified wall for use in the shipping container.

Additionally, as will be apparent from a consideration of FIGS. 23 and 24, the fold-down wall section 123 can be opened even where one or more additional shipping containers are stacked on top of the one to which access is required. As will be evident from FIG. 24, the latches 125 can be manipulated from the closed condition and raised in the recesses 143 without interference from the superimposed upper shipping container. With reference to FIG. 24 it will be seen that the rib 142 at the upper end of the fold-down wall section 123 is received within the recess 94 of the base 11. The lugs 133 at the upper end of the main wall section 122 are received in the ends of this recess 94, and interact therewith to stiffen the wall section 121 against horizontal forces tending to spread the lugs 133 away from one another.

All components of the container are preferably fabricated in moulded plastics material and this provides the advantages of ease of cleaning, corrosion resistance, lightness and quietness in use. Furthermore, because of the materials the container is virtually maintenance free and is safe for use in food contact applications. Since all components of the container including the hinges and fasteners are moulded in thermoplastic material, there is an important advantage when the useful life of the container has ended and it is melted down for recycling. This advantage is that no costly separation of the different components of the container is necessary, but rather the entire container can be fed through a chopper or like device where it is severed into small pieces for recycling.

The unique wall configuration and fastener arrangement enables the container to be erected and collapsed very rapidly and simply by a single worker and without the use of any tools. Furthermore the fact that the locking pins 58 and latch pins 125 are held captive on the walls means that there is no danger of their becoming detached or lost.

We claim:

1. A collapsible shipping container comprising: a rectangular base, and four side walls each attached at a respective side of the base and capable of only pivotal movement on a horizontal axis parallel to that side, each wall being pivotable between an upright position, wherein it extends normal to the base, and a retracted position wherein it overlies the base, the container being adjustable from an erected condition, wherein all four walls are in the upright position, to a collapsed condition wherein all four walls are in the retracted position, the adjacent edges of neighboring walls being configured to provide mutual support when in the upright position, said walls carrying captive releasable fastener means that engage between neighboring walls to lock them in the upright position, said fastener means comprising a latch pin and a parallel mounting pin fixedly interconnected by a transverse strap, said mounting pin being axially movably carried in an edge region of one wall whereby the latch pin is selectively insertable axially in a direction generally parallel to said adjacent edge into a socket in an adjacent wall to secure said walls together in the upright position with said latch pins and mounting pins extending in a generally upright orientations on axes normal to any horizontally directed separation forces applied to said walls, there being an auxiliary socket in the wall in which the mounting pin is carried, said auxiliary socket receiving said latch pin in a non-operative stored condition.

2. A container according to claim 1 wherein said base includes four upstanding posts at the corners thereof, said posts being of the same height and each including at its top an upwardly projecting stud means adapted to be received in a complimentary recess in the underside of the base of a like container when two such containers are stacked in collapsed condition.

3. A container according to claim 1 wherein the container base has a dependent peripheral wall with a continuous lower edge surface, each of the four sides of said peripheral wall having a pair of pocket openings extending therethrough to facilitate handling of the containers by the tines of fork-lift truck.

4. A container according to claim 2 wherein each side wall is pivoted between one pair of said posts, the post supporting a pivot pin that is received in a complementary recess in the adjacent lower corner of the side wall, each side of the base including a central upwardly projecting lug which is received in a complementary pocket in the outer side of the lower edge of the side wall when the latter is in the upright position, to support this portion of the side wall against outward displacement.

5. A container according to claim 4 wherein the upper edge of each wall includes an upwardly projecting elongate rib which is adapted to be received in a complementary groove in the underside of a container base when two such containers are stacked in the erected condition.

6. A container according to claim 1 wherein an integral card receiving recess is moulded in an outer face of at least one of the container walls.

7. A container according to claim 1 wherein the configuration of the adjacent edges of neighbouring walls to provide mutual support when in the upright position comprises one pair of opposed walls each of which has along both vertical edges a projecting rib, each of the other pair of walls having along its vertical edges a complimentary groove, so that a wall of the second pair is supported against outward swinging movement away from the upright position by interengagement of its grooves with the ribs on the adjoining walls, said latch pins being held captive by their mounting pins being inserted in a wall of said first pair, so that when engaged, the strap of each fastener means acts to support the associated wall of the first pair against outward swinging movement.

8. A container according to claim 1 wherein a first pair of opposed walls of the container have on the lateral edges thereof longitudinally extending projecting ribs adapted in the erected condition of the container to support the walls of the second pair against outwards displacement, the walls of the second pair when in the erected condition being supported against outwards displacement at their upper ends by said latch pins and at their lower ends by the pivotal attachment thereof to the base.

9. A container according to claim 8 wherein said base includes four upstanding posts at the corners thereof, each wall being pivotally attached between a pair of said posts, the walls of the second pair being configured to interengage with their associated posts in the erected condition to support said posts against deflection, such that forces tending to produce outwards displacement of the lower ends of the walls of the first pair are transmitted through the posts and absorbed as tensile forces in the walls of the second pair.

10. A collapsible shipping container formed substantially entiredly of roto-moulded plastics material comprising: a rectangular base, said base including four upstanding posts at the corners thereof, said posts being of the same height and each including at its top an upwardly projecting stud means adapted to be received in a complementary recess in the underside of the base of a like container when two such containers are stacked in collapsed condition, said base having a dependent peripheral wall with a continuous lower edge surface, each of the four sides of said peripheral wall having pocket opening means extending therethrough to facilitate handling of the containers by the tines of fork-lift truck;

four side walls each pivotally attached between two of said posts at a respective side of the base on a horizontal axis parallel to that side;

each wall being pivotable between an upright position, wherein it extends normal to the base, and a retracted position wherein it overlies the base, the container being adjustable from an erected condition, wherein all four walls are in the upright position, to a collapsed condition wherein all four walls are in the retracted position;

lug means being provided in a central region of each upper edge of the base, said lug means being received in a complementary recess in the lower outer edge of the associated wall when in the upright position to support the lower edge of the wall against load-induced outwards deflection;

the adjacent edges of neighboring walls being configured to provide mutual support when in the upright position;

said walls carrying captive releasable fastener means that engage between neighboring walls to lock them in the upright position;

said fastener means comprising a latch pin movably attached to one wall and selectively insertable in a socket in an adjacent wall to secure said walls together in the upright position with said latch pins extending in a generally upright orientation on axes normal to any horizontally directed separation forces applied to the walls.

11. A container according to claim 10 wherein said fastener means also includes a mounting pin by which it is attached to the associated wall and means rigidly interconnecting said latch pin and mounting pin in parallel relationship, said mounting pin being pivotable and axially movable on the wall to which it is attached to permit insertion or removal of the latch pin in said socket, an auxiliary socket being provided on the wall to which the fastener is attached to receive said latch pin in a stored condition when the fastener is not in use.

12. A container according to claim 11 wherein said mounting pin is pivotable and axially novable on the wall to which it is attached to permit insertion or removal of the latch pin in said socket, an auxiliary socket being provided on the wall to which the fastener is attached to receive said latch pin in a stored condition when the fastener is not in use.

13. A container according to claim 11 wherein said fastener means is an integral plastics moulding and wherein said latch pin is tightly received in both sockets to avoid inadvertent displacement therefrom.

14. A container according to claim 10 wherein said side walls and said base are of hollow roto-moulded construction, each said side wall having outer and inner panels that are continuously interconnected around the edges thereof and interconnected in the central areas thereof by elongate bracing formations, said bracing formations being provided by integral deformations of one panel into contact with the other panel.

15. A container according to claim 10 wherein an upper section of one said side wall is pivotally mounted with respect to a lower section thereof and can be swung outwardly and downwardly to facilitate access to the container when in erected condition said upper section being received within a cut-out opening from the top of said one side wall, said upper section having a closed position wherein it is coplanar with the remainder of the side wall and substantially fills said cut-out, captive latch means being provided and being selectively operable to latch said upper section in its closed position.

16. A container according to claim 15 wherein said captive latch means comprise latch pins, for each latch pin there being a bore in said upper wall section that in the closed position of the latter registers with a mating bore in the side wall so that the latch pin can be simultaneously engaged in both bores to lock the upper section in its closed position and at the same time transmit horizontal forces between the upper section and its associated side wall.

17. A container according to claim 16 wherein each latch pin is held captive in a lateral projection of said upper section and comprises a cylindrical rod having a lever projecting laterally from one end thereof, said lever, when the upper section is in the closed position, being adapted to be received in a recess in the upper section and releasably retained therein, disengagement of said cylindrical rod from said registering bores being prevented when the lever is so positioned, said latch pin being pivotable about said cylindrical rod to swing said lever out of engagement with said recess whereupon said latch pin can be manipulated by means of the lever to disengage the cylindrical rod from one of the aligned bores.

* * * * *